343-909 SR
8/17/76 XR 3,975,738

United States Patent [19]
Pelton et al.

[11] 3,975,738
[45] Aug. 17, 1976

[54] PERIODIC ANTENNA SURFACE OF TRIPOLE SLOT ELEMENTS

[75] Inventors: Edward L. Pelton; Benedikt A. Munk, both of Columbus, Ohio

[73] Assignee: The United States of America as represented by the Secretary of the Air Force, Washington, D.C.

[22] Filed: May 12, 1975

[21] Appl. No.: 576,503

[52] U.S. Cl. ..... 343/872; 343/909
[51] Int. Cl.[2] ..... H01Q 1/42
[58] Field of Search ..... 343/754, 767, 770, 771, 343/909, 872

[56] References Cited
UNITED STATES PATENTS 3,231,892 1/1966 Matson et al. ..... 343/909
3,842,421 10/1974 Rootsey et al. ..... 343/909

*Primary Examiner*—Eli Lieberman
*Attorney, Agent, or Firm*—Joseph E. Rusz; Julian L. Siegel

[57] ABSTRACT

An antenna system in which a conical shaped metallic radome has a surface composed of a periodic array of radiating slot elements. Each slot element has three arms connected to each other and extending radially outward with the angular distance between adjacent arms equal to 120°. The slot elements are aligned in order to have each of the arms in an element parallel to an arm in an adjacent element forming a uniform periodic array.

3 Claims, 5 Drawing Figures

FIG. 4
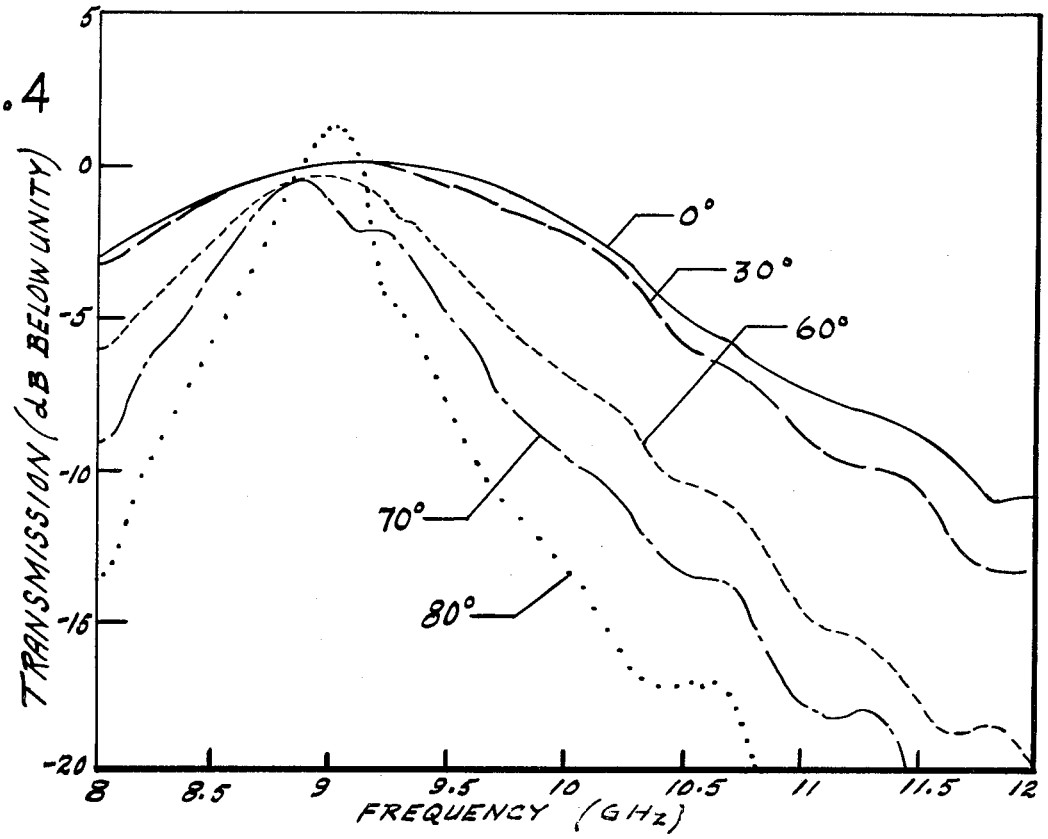
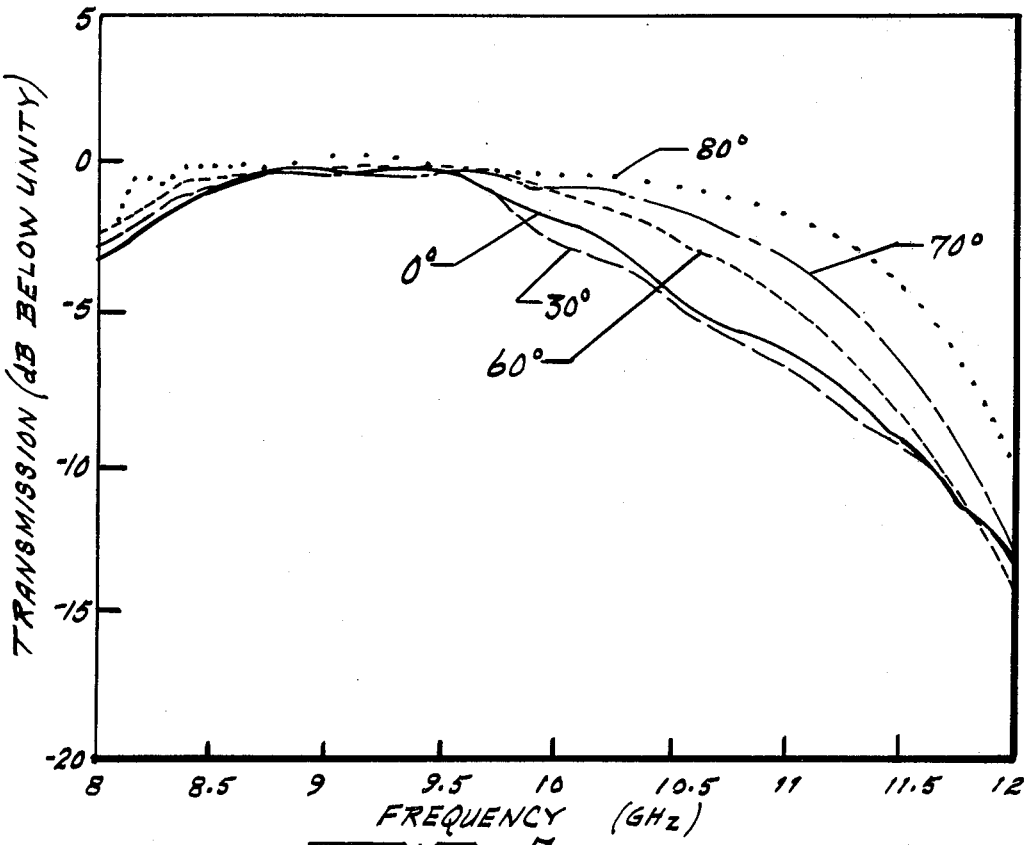
FIG. 5

PERIODIC ANTENNA SURFACE OF TRIPOLE SLOT ELEMENTS

STATEMENT OF GOVERNMENT INTEREST

The invention described herein may be manufactured and used by or for the Government for governmental purposes without the payment of any royalty thereon.

BACKGROUND OF THE INVENTION

This invention relates to antenna systems, and more particularly to a metallic radome having a periodic array of slotted elements in its surface.

The study of metallic radomes has received increased emphasis in recent years. The increased interest in metallic radomes is largely due to their potential in overcoming the mechanical and electrical limitations of conventional dielectric radomes in high-speed, all-weather aircraft applications. A metallic radome offers the potential for greater overall mechanical strength and enhanced resistance to environmental stresses caused by rain, hail, dust and lightning, compared to conventional dielectric or ceramic radomes. The signal reception problem caused by static charge buildup and subsequent discharge to the airframe, encountered with dielectric radomes, could be eliminated by use of a metallic radome. A metallic radome could also better distribute frictionally induced heating arising from high speed flight. Finally, a metallic randome could conceivably be made lighter in weight than a dielectric radome.

The metallic radome concept also represents a useful alternative approach in overcoming the inherent electrical performance limitations of dielectric radomes. Most dielectric radomes are designed with a thickness of about a half-wavelength, to minimize impedance mismatch (i.e., reflection) losses. The optimum thickness, however, depends on the incidence angle, polarization, and frequency of the signal. Therefore, when the beam of the antenna enclosed by the radome is scanned, the radome introduces varying amounts of insertion loss and phase in the transmitted or received signals. The varying insertion phase is particularly troublesome, since it causes a change in the beam direction. This may in turn cause a significant deterioration in the performance of a tracking radar.

The metallic radome presented herein offers an improved transmission performance using a realistically streamlined radome shape. The novel slotted periodic surface design employed as the radome surface provides nearly ideal transmission properties for signal frequencies within its design band. The radome can accommodate scanning antennas transmitting arbitrarily polarized signals over an unrestricted range of scan angles.

SUMMARY OF THE INVENTION

The subject invention is a periodic array of slot elements mounted in the surface of a metallic radome. Each of the slot elements has a tripole configuration, having three arms connected at the center with the angular difference between the arm of 120°.

It is an object of this invention to provide an antenna system using a metallic radome having slot elements mounted upon its surface.

It is another object to provide an antenna array composed of periodic surfaces having flexibility to conform to arbitrarily curved surfaces.

It is still another object to provide an array of antenna slots that have a frequency stable pass band regardless of polarization or angle of incidence.

It is yet another object to provide an antenna slot element that has reactive loading and offers superior resonant frequency stability.

These and other objects, features and advantages of the invention will become more apparent from the following description taken in connection with the illustrative embodiment in the accompanying drawings.

DESCRIPTION OF DRAWINGS

FIG. 4 is a graph showing measured H-plane transmission versus frequency characteristics for various scan angles; and FIG. 5 is a graph showing measured E-plane transmission versus frequency characteristics for various scan angles.

DETAILED DESCRIPTION OF THE PREFERRED EMBODIMENT

The invention presents an antenna system using a multiplicity of radiating elements on the surface of a metallic radome;

The surface design of the radome provides virtually complete transmission in a narrow-frequency band, for all incidence angles and for any polarization of the incident field.

Figure 1:
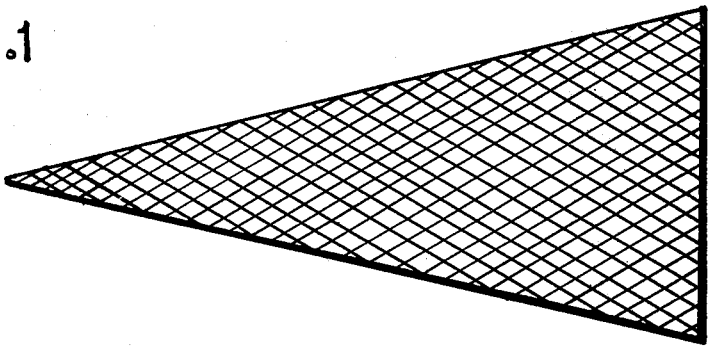
FIG. 1 is a diagram of the conical metallic radome.

Although it is a simple matter to design periodic flat slotted surfaces, it is not at all clear in general how to construct such a surface in the shape of a radome. Measurements have revealed that breaks in the periodicity of such surfaces can, depending upon the severity of the discontinuities, result in considerable amounts of transmission loss and phase distortion. Thus it is highly desirable that a metallic radome employing a periodic slotted surface be as nearly as possible completely periodic and homogeneous over its entire surface. Most radomes on high speed aircraft are ogival in shape, though not deviating substantially from conical. In view of the difficulty of constructing a metallic radome in the shape of an ogive, it is preferred to construct a conical radome which is shown in FIG. 1.

Figure 3:
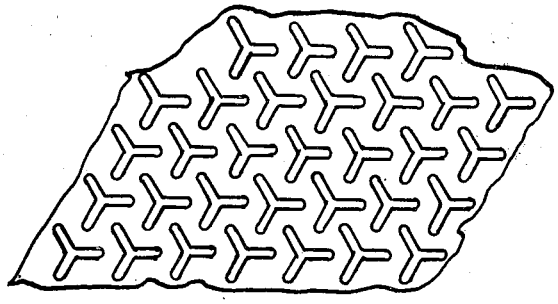
FIG. 3 shows an array of the slot elements of FIG. 2 which is mounted on the surface of the metallic radome shown in FIG. 1.

In the surface of the metallic radome there is an array of slot elements, in which the elements of the array are arranged in a triangular grid and the elements consist of three arms (from which the term "tripole" originated), with the relative orientation of the arms designed to conform to the chosen triangular grid structure, e.g., the arms of the elements as shown in FIG. 3 are separated by 120° to conform to the equilateral triangle grid structure. The length of each arm is 0.16λ (λ being the wavelength of the radiated or received signal. The width of the arms are 0.07λ and the slot width is 0.0175λ.

One of the requirements for the metallic radome is that the fineness ratio (ratio of length to base diameter) of the radome be approximately 3 to 1. Hence, for energy propagating parallel to the radome axis, the angle of incidence on the radome surface is in excess of 80°. It is desired that the radome be capable of transmitting arbitrarily polarized signals of scanning antennas, without deteriorating the enclosed antenna's performance. In the usual case, where the antenna employed has an aperture nearly as large as the base of the radome, the angle of incidence varies from 0° to 90°. This requires the slotted periodic surface to be capable of low-loss transmission and have uniform insertion phase for signals of any angle of incidence and polarization. The novel slotted metallic surface configuration developed to meet the above requirements is shown in FIG. 3.

Figure 2:
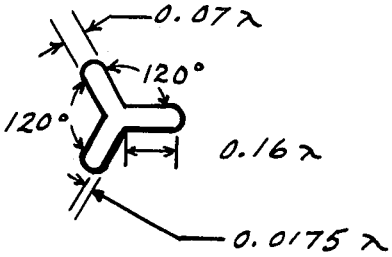
FIG. 2 is a diagram of a single slot element used in the invention.

Measured H-plane and E-plane transmission versus frequency characteristics are shown in FIGS. 4 and 5, respectively, for a planar slotted periodic surface of the design shown in FIGS. 2 and 3. As shown by the data of FIGS. 4 and 5, the periodic surface functions as a bandpass filter of electromagnetic signals. FIG. 4 shows the measured H-plane characteristics where transmission is plotted against frequency. The various resulting curves are for different scan angles. Similarly, the E-plane characteristics are shown in FIG. 5 for different scan angles.

The unique design provides virtually complete transmission at the resonant frequency (8.90 GHz) for all incidence angles. It can be noted by comparing FIGS. 4 and 5 that the transmission bandwidth becomes narrower for increasing angles of incidence in the H-plane (FIG. 5) and broader with increasing incidence angle in the E-plane (FIG. 4). This property is characteristic of periodic thin slotted surfaces in general. The H-plane bandwidth decreases roughly by the factor $\cos\theta$, while the E-plane bandwidth increases approximately as $1/\cos\theta$, where the angle $\theta$ is the angle of incidence.

It has been well established that arrays of straight half-wavelength slots exhibit sizable shifts in resonance for varying incidence angles, and are thus unsuitable for the broad angle requirements of a streamlined radome. It also has been shown that shorter slots, capacitively loaded at the center, can be employed to stabilize the array resonant frequency over a broad range of incidence angles. Subsequently, the bipolar slot geometry was developed for applications requiring arbitrary polarization. The bipolar slot geometry is best suited to a rectangular array grid structure and is shown and described in U.S. Pat. No. 3,789,404 issued on Jan. 29, 1974 to one of the co-applicants. For the radome application, however, it is an improvement to employ a triangular grid structure, both because this grid structure is more suitable for maintaining the required surface periodicity on radome shapes, and because the triangular grid array provides superior resonant frequency stability in applications where the signal polarization varies with respect to the grid orientation.

The slot design described in the present invention incorporates reactive loading, a feature which is instrumental in producing a very frequency-stable pass for all incident signals, regardless of polarization or angle of incidence.

The superior frequency stability of the band filter characteristics for all incidence angles and signal polarizations is one of the important unique properties of the invention. Another unique feature of the invention is the design flexibility it affords in creating periodic surfaces conforming to arbitrarily curved surfaces. Since virtually all important applications of periodic surfaces require their use in curved (i.e., non-planar) surface geometries, this design flexibility is an important attribute of the invention.

What is claimed is:

1. An antenna system comprising:

a. a metallic radome; and b. a periodic array of slot elements mounted equidistant from each other upon the radome with each of the slot elements having three arms joined at the center with an angular separation of 120° and with each of the arms of the slot elements being in parallel alignment with the one of the arms of the other slots.

2. An antenna system according to claim 1 wherein the shape of the metallic radome is conical.

3. A radiating surface comprising a multiplicity of radiating slot elements with each of the elements having three radial arms joined at the center and each of the arms having an angular distance of 120° from an adjacent arm and with the elements aligned to have one arm of each element parallel to one arm of an adjacent element forming a periodic array.

* * * * *